United States Patent [19]

Haddy

[11] Patent Number: 4,690,631

[45] Date of Patent: Sep. 1, 1987

[54] PACKERHEAD WITH ELASTIC ROLLERS

[75] Inventor: Michael L. Haddy, Harlinger, Tex.

[73] Assignee: Hydrotile Machinery Company, Nashua, Iowa

[21] Appl. No.: 837,097

[22] Filed: Mar. 6, 1986

[51] Int. Cl.[4] ..... B28B 21/24

[52] U.S. Cl. ..... 425/262; 425/328; 425/418; 425/427; 425/429; 425/447; 425/460; 425/471

[58] Field of Search ..... 425/145, 262, 324.1, 425/328, 418, 426, 427, 429, 447, 449, 457, 460, 468, 470, 471

[56] References Cited

U.S. PATENT DOCUMENTS

| | | | |
|---|---|---|---|
| 1,904,094 | 4/1933 | Snyder | 264/309 |
| 2,758,352 | 8/1956 | Perkins | 425/262 |
| 2,937,429 | 5/1960 | Livingston | 425/59 |
| 3,262,175 | 7/1966 | Gourlie et al. | 425/117 |
| 3,276,091 | 10/1966 | Pausch | 425/262 |
| 3,551,968 | 1/1971 | Fosse et al. | 425/162 |
| 3,619,872 | 11/1971 | Fosse | 425/426 |
| 3,649,727 | 3/1972 | Gauger | 29/116 R |
| 3,689,967 | 9/1972 | Hurst | 29/132 |
| 3,746,494 | 7/1973 | Gauger | 425/262 |
| 3,786,549 | 1/1974 | Pott | 29/116 R |
| 3,865,536 | 2/1975 | Johnson et al. | 425/472 |
| 3,960,644 | 6/1976 | McFadden | 156/390 |
| 4,067,680 | 1/1978 | Perkins | 425/460 |
| 4,334,848 | 6/1982 | Gross et al. | 425/262 |
| 4,340,553 | 7/1982 | Fosse | 264/40.7 |
| 4,406,605 | 9/1983 | Hand | 425/262 |
| 4,407,648 | 10/1983 | Fosse | 425/457 |
| 4,540,539 | 9/1985 | Crawford et al. | 425/262 |

*Primary Examiner*—Willard E. Hoag

*Attorney, Agent, or Firm*—Burd, Bartz & Gutenkauf

[57] ABSTRACT

A packerhead concrete pipe making machine having a rotatable packerhead operable to form a concrete pipe in an upright cylindrical mold about a wire cage. The packerhead has a plurality of rollers rotatably mounted on a circular plate operable to pack concrete into a cylindrical shape in the mold. Each roller has an outer sleeve of elastic rubber material. A cylindrical wall secured to the plate supports an annular troweling member operable to finish the inside surface of the concrete pipe.

26 Claims, 7 Drawing Figures

PACKERHEAD WITH ELASTIC ROLLERS

TECHNICAL FIELD

The invention is in the field of concrete product making machines known as packerhead concrete pipe making machines. These machines have packerheads that are concurrently rotated and elevated relative to molds continuously supplied with concrete to form concrete pipes.

BACKGROUND OF INVENTION

Conventional packerhead concrete pipe making machines are equipped with rotatable packerheads that are moved in upward directions in molds to form a concrete pipe. Conveyors transport concrete from hoppers into molds above the packerheads. The packerheads have a plurality of rollers that pack concrete into an annular shape adjacent the inside of a mold. Annular trowels located below the rollers finish the inside of the concrete pipes. The concrete and aggregate therein is abrasive material. The rollers being made of metal readily slide on the concrete and are easily stopped. A roller that does not rotate is subject to substantial wear and will quickly become inoperative. The metal rollers are rigid so that they subject the top rings of the molds to considerable force as the packerheads moves up into the feeding table. This can deform and break the top rings. Examples of packerheads having a plurality of rollers and an annular trowel are disclosed in the U.S. patents to Gourlie et al U.S. Pat. No. 3,262,175; Fosse et al U.S. Pat. No. 3,551,968; Gauger U.S. Pat. No. 3,649,727; Gross et al U.S. Pat. No. 4,334,848; and Fosse U.S. Pat. No. 4,340,553. The packerheads shown in these patents have conventional cylindrical metal rollers that are susceptible of slipping and stalling during rotation of the packerheads in the molds to form the pipes. Stalled rollers do not independently rotate about their axes causing excessive and premature wear of the outer surfaces thereof.

SUMMARY OF THE INVENTION

The invention is directed to a machine for making a concrete product, such as a concrete pipe, in an upright generally cylindrical mold. The machine has a frame and a packerhead movably mounted thereon. The packerhead is adapted to be located in a mold chamber of the generally upright mold. The machine has a crosshead connected to the packerhead. Lift means, such as hydraulic fluid operated cylinders, are used to selectively raise and lower the crosshead and packerhead. A drive means mounted on the crosshead is operable to rotate the packerhead so that the packerhead is concurrently rotated and elevated during the forming of the concrete pipe. The packerhead has a base plate that is connected to the drive means. A plurality of rollers are rotatably mounted on top of the base plate for rotation about separate generally upright axes. The rollers function to move and pack concrete in generally cylindrical shape and form with the mold the cylindrical concrete pipe. Each of the rollers has an upright roller shaft secured to the plate and projected upwardly therefrom. A body surrounds the roller shaft. The body has a generally cylindrical outer surface. Bearings rotatably mount the body and the roller shaft. An elastic sleeve surrounds the body and is mounted with a press fit on its cylindrical outer surface. The material of the sleeve is under tension around the body. The elastic sleeve has a generally continuous outer surface that is engageable with the concrete in the mold chamber to insure rotation of the roller and the packing of the concrete in the mold. The sleeve is made of elastic material, such as relatively hard rubber, which has a substantially greater traction on the concrete in the mold as compared to a steel roller. This ensures the continuous rotation of the roller during the rotation of the packerhead in the mold. A generally cylindrical trowel is secured to the plate and extends downwardly therefrom. The trowel has an annular surface for troweling in the inside surface of a pipe during movement of the packerhead relative to the mold. The trowel has replaceable segments of abrasion resistant material.

The invention includes a roller for a packerhead usable in a concrete product making machine. The roller has a roller shaft adapted to be fixed to a part of the packerhead. A generally cylindrical body surrounds the roller shaft. The body has a generally cylindrical surface. One or more bearings rotatably mount the body on the roller shaft. A sleeve of elastic material surrounds the body and is mounted thereon. The sleeve has an inside wall located in a press fit relationship on the cylindrical outer surface of the body. The sleeve is in continuous tension to retain the sleeve on the body. A connector secures the sleeve to the body to prevent a rotation of the sleeve relative to the body. One form of the roller has a sleeve made of a continuous annular elastic rubber member. The rubber member is located in a pressed fit relationship relative to the cylindrical outer surface of the body. The material in the rubber member is continuously under tension and to retain the rubber member on the body and yet allow the rubber member to deform as it works the concrete in the mold. The rollers have caps carrying one or more fins. The fins extend upwardly into the concrete and mix and move concrete toward the mold during the rotation of the roller as the packerhead turns in the mold. The elastic sleeve insures that the rollers keep turning during the forming of the pipe. This overcomes the sticking and stopping of the prior art metal rollers. The useful life of an elastic roller is substantially greater than the useful life of the conventional steel roller of a packerhead. The rollers equipped with elastic sleeves have moving surface contact with the concrete in mold during the packing of the concrete. One result of the surface packing of the concrete is a smooth cylindrical outside surface on the pipe. In other words, the cylindrical outside surface of the completed pipe has a smooth finish. The elastic sleeves of the rollers are capable of being compressed and deformed so that as the packerhead moves through the top ring of the mold less force is applied to the top ring thereby minimizing the deforming and destruction of the top ring.

DESCRIPTION OF PREFERRED EMBODIMENT

Figure 1:
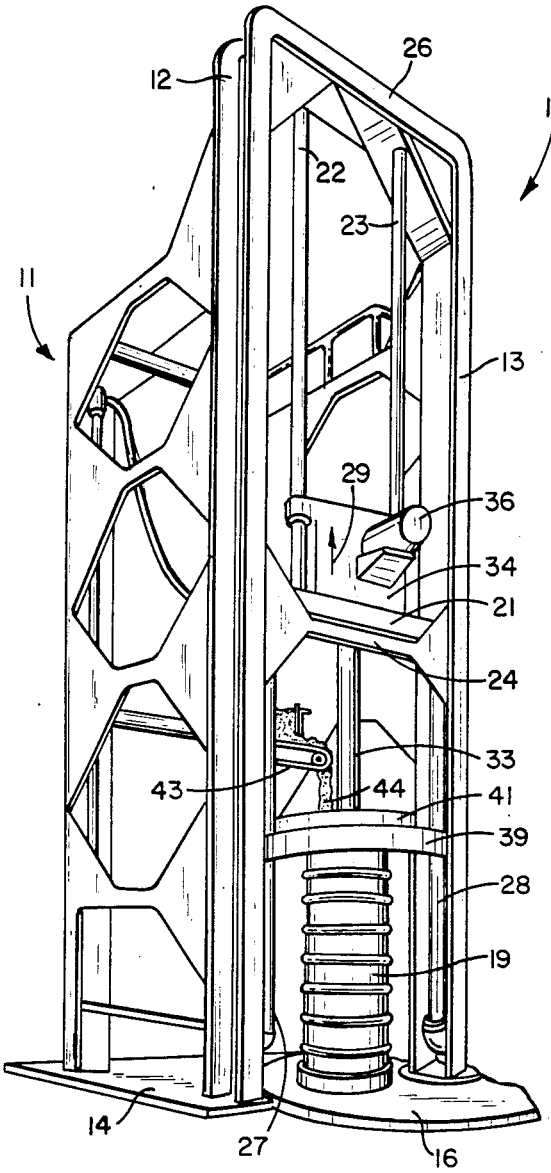
FIG. 1 is a perspective view of a packerhead concrete product making machine equipped with the packerhead of the invention.

Referring to FIG. 1, there is shown a perspective view of a packerhead concrete pipe making machine indicated generally at 10 operable to make concrete products, such as wire cage reinforced concrete pipes. Machine 10 has an upright framework indicated generally at 11 comprising a number of upright beams joined to cross beams including main upright front I-beams 12 and 13 joined together with a mid-cross beam 24 and a top-cross beam 26. The beams and cross beams of the framework are welded together to provide a strong unitary frame structure. The entire machine is supported on a generally flat support or floor 14 carrying a rotatable horizontal turntable 16. Turntable 16 supports an annular pallet 17 and an upright cylindrical jacket or mold 19 used in making a concrete product, such as a concrete pipe. Turntable 16 has a number of mold stations for additional molds and pallets to facilitate the stripping of the molds from completed concrete pipes and setting up molds on the turntable.

A crosshead indicated generally at 21 extends horizontally between beams 12 and 13 above cross beam 24. A pair of upright cylindrical guides 22 and 23 movably support cross head 21 for vertical movement between a first or lower position and an up or upper position adjacent top cross beam 26. The lower ends of guides 22 and 23 are secured to cross beam 24 and the upper ends thereof are secured to top cross beam 26.

A pair of packerhead lift hydraulic cylinders 27 and 28 supported adjacent the lower ends of beams 12 and 13 are attached to opposite ends of crosshead 21. Lift cylinders 27 and 28 are double acting hydraulic fluid operated piston and cylinder assemblies operable to move crosshead 21 and the packerhead, indicated generally at 32, connected thereto along an upright path 29 established by vertical guides 22 and 23. In large packerhead concrete pipe making machines, pairs of lift cylinders supported on each beam 12 and 13 are used to vertically move crossheads and packerheads connected thereto. A source of fluid under pressure and suitable control valves (not shown) are used to operate lift cylinders 27 and 28.

Figure 2:
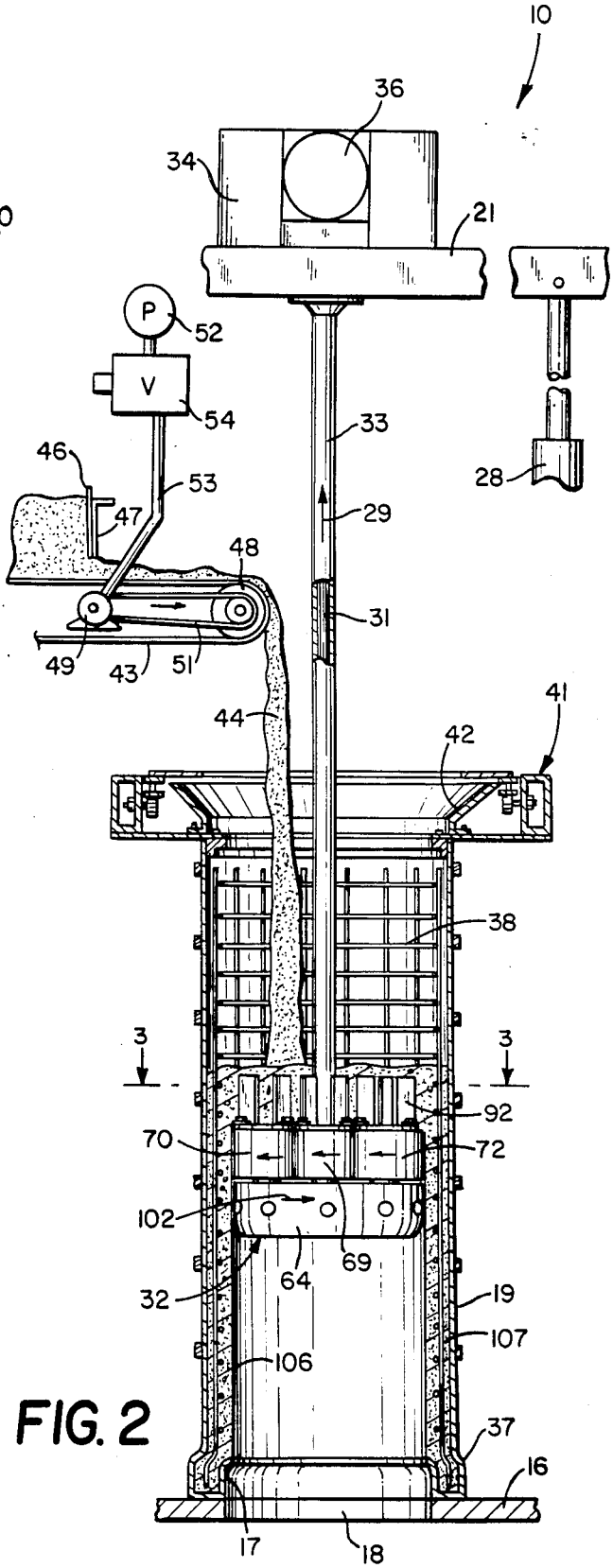
FIG. 2 is a diagrammatic view of the packerhead concrete product making machine of FIG. 1 showing the mold in section and packerhead therein.

As shown in FIG. 2, crosshead 21 supports a downwardly directed drive shaft 31 surrounded by a tubular member or sleeve 33. Packerhead 32 is connected to the lower end of drive shaft 31. The upper end of drive shaft 31 is connected to a power transmission or gear box 34 mounted on top of crosshead 21. An electric motor 36 mounted on transmission 34 drives the transmission which in turn rotates drive shaft 31 and packerhead 32. A conventional power cable couples electric motor 36 to an electric power source and controls thereof. Motor 36 can be a fluid operated motor connected to a source of fluid under pressure.

Machine 10 has a feeder table 39 located adjacent the top of mold 19. Feeder table 39 supports a concrete feeding device 41 having a downwardly converging funnel or cone member 42, as shown in FIG. 2, to direct concrete into the mold chamber above packerhead 32. Concrete feeding device 41 is disclosed in U.S. Pat. No. 3,551,968 which is incorporated herein by reference.

As shown in FIG. 2, a conveyor 43 is operable to continuously discharge a ribbon of concrete 44 into concrete feeding device 41 which directs the concrete into the mold chamber above packerhead 32. Conveyor 43 is operable to move concrete from a hopper or bin 46 and deliver the concrete to the mold chamber. The outlet of hopper 46 has an adjustable gate 47 located above conveyor 43. The conveyor 43 is an endless belt-type conveyor trained about a drive roller 48. A motor 49, such as a hydraulic motor, is drivably connected to drive roller 48 with a power transmission 51, such as a gear reducer, chain drive or the like. Motor 49 drives conveyor 43 at a desired speed to regulate the amount of concrete that is discharged into the mold chamber above packerhead 32. Motor 49 is operatively coupled to a pump 52 with fluid lines or hoses 53. A control valve 54 interposed in line 53 controls the speed of operation of motor 49. The speed of the conveyor 43 can be automatically controlled in response to the load on motor 36 or the torque on drive shaft 31 required to rotate packerhead 32 to maintain a desired supply of concrete above packerhead 32: An example of a conveyor speed control is shown by Fosse in U.S. Pat. No. 4,340,553. Motor 49 can be an electric motor. A control can be used to operate the conveyor electric motor in response to the load on electric motor 36 for rotating the packerhead 32 to maintain a supply of concrete above the packerhead. A suitable electric control system is disclosed in U.S. Pat. No. 3,459,378.

Figure 4:
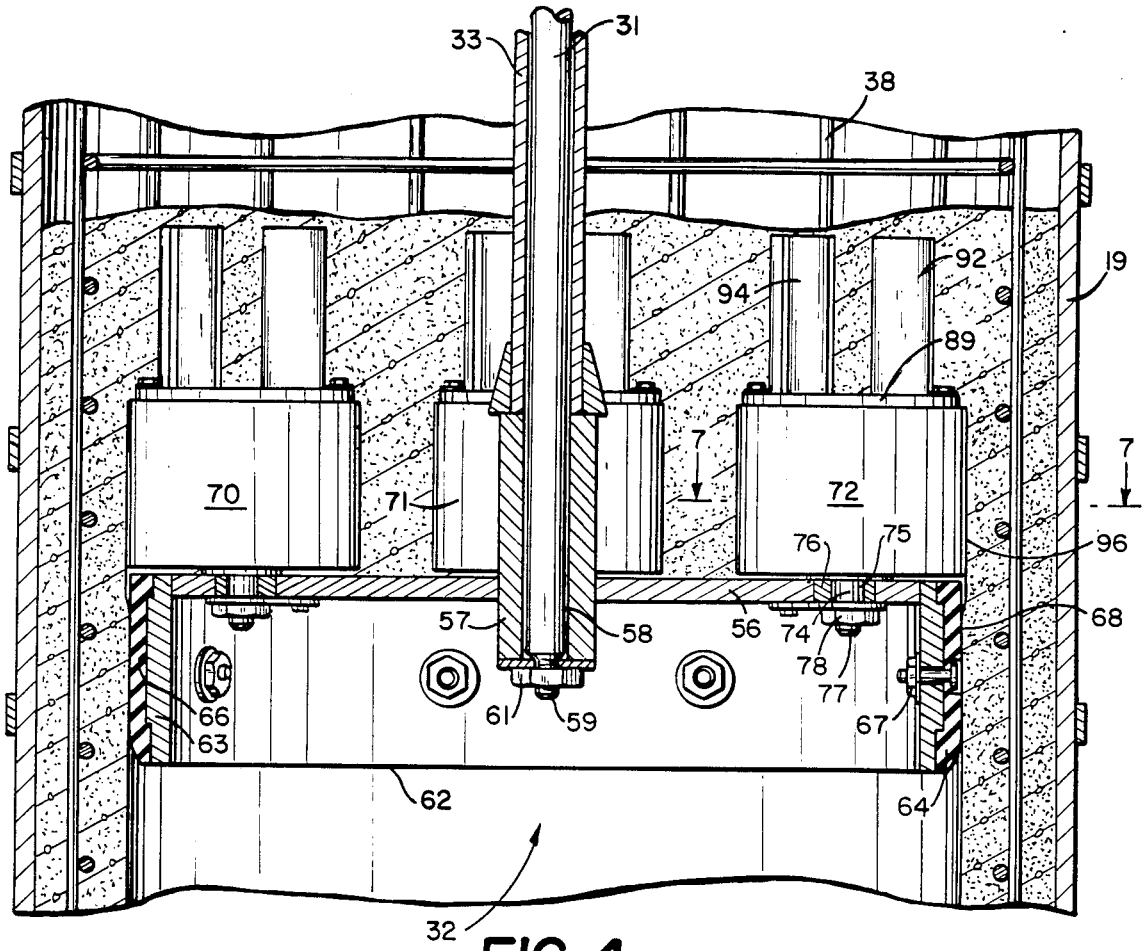
FIG. 4 is an enlarged sectional view taken along the line 4—4 of FIG. 3.

Referring to FIG. 4, packerhead 32 has a generally flat horizontal circular base plate or wall 56 surrounding and secured to an upright hub 57 having a passage 58. The lower end of drive shaft 31 extends through passage 58 and terminates in a threaded end 59. A nut 61 turned onto end 59 secures hub 57 to shaft 31. A key (not shown) or other suitable means, such as splines, join shaft 31 to hub 57 so that packerhead 32 rotates with shaft 31.

A downwardly directed cylindrical side wall 62 is secured to the outer peripheral edge of plate 56. Wall 62 has an outwardly generally flat annular rib 63 spaced inwardly from the top and bottom of wall 62. A trowel sleeve 64 having a plurality of arcuate segments is located about the outside of wall 62. Sleeve 64 is made of wear and abrasive resistant materials including metal and synthetic materials. The inside of sleeve 64 has a groove 66 to accommodate rib 63. A plurality of nut and bolt assemblies 67 secure sleeve 64 to wall 62. Sleeve 64 has a continuous cylindrical outer surface 68 which serves as an annular troweling surface for finishing the inside surface 106 of concrete pipe 107.

Figure 3:
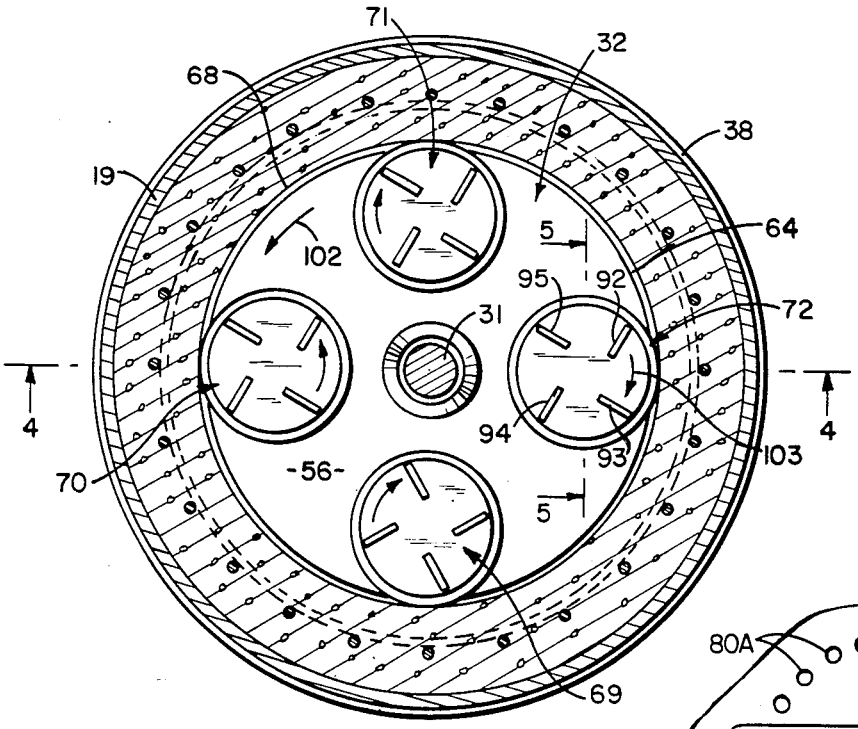
FIG. 3 is an enlarged sectional view taken along the line 3—3 of FIG. 2.

Referring to FIG. 3, there is shown the top of packerhead 32 with the concrete removed therefrom. Packerhead 32 has four circumferentially spaced rollers indicated generally at 69, 70, 71, and 72. Each roller rotates about a generally upright axis. Adjacent axes of the rollers are circumferentially spaced 90 degrees from each other. The axes of rollers 69–72 extend upwardly from plate 56 generally parallel to the axis of rotation of shaft 31. Each of the rollers 69–72 rotate independently about their axis during the rotation of the packerhead to pack and compress the concrete in an annular configuration around the inside of mold 19 and around wire cage 38. Rollers 69–72 have the same diameters and vertical dimensions or height. The height of each rollers is substantially the same as the height of troweling sleeve 64.

Figure 6:
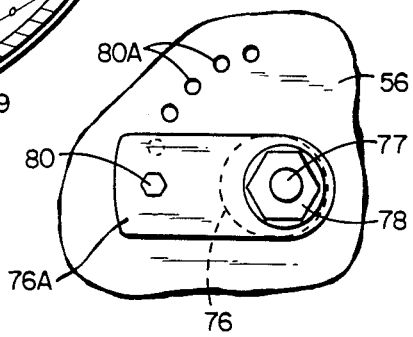
FIG. 6 is an enlarged sectional view taken along line 6—6 of FIG. 5.
Figure 5:
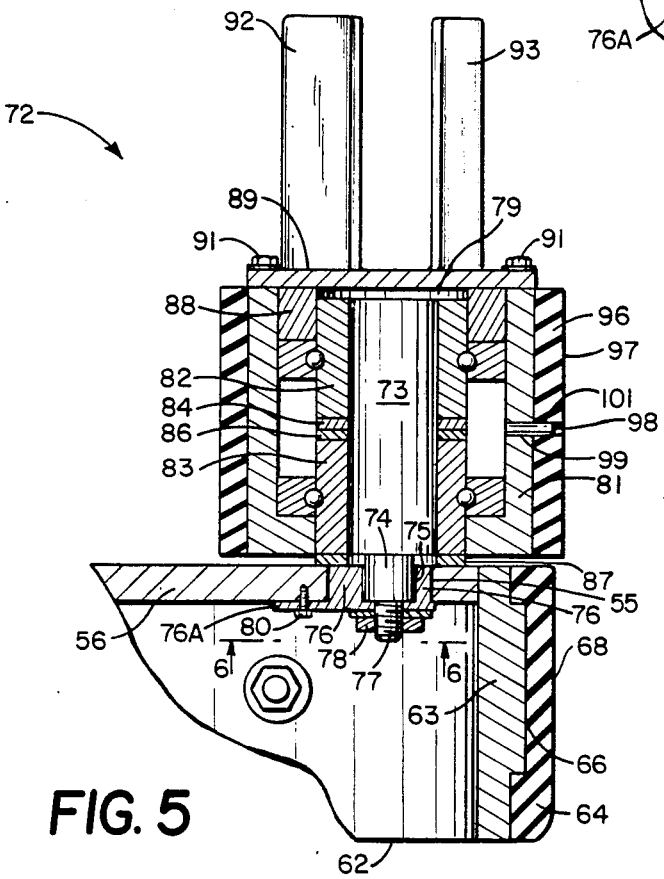
FIG. 5 is an enlarged sectional view taken along the line 5—5 of FIG. 3.

Each of the rollers 69–72 are rotatably attached to the packerhead plate or top wall 56. The following description is directed to roller 72 as shown in FIG. 5. Rollers 69–71 are mounted on plate 56 in a similar manner. An upright axle or roller shaft 73 is mounted on plate 56. Axle 73 has a downwardly directed cylindrical hub 74 extended through a hole 75 in an eccentric bushing or cylindrical member 76. Hole 75 is off-center relative to the circular outer surface of the bushing 76. Bushing 76 is located in a hole 55 in an outer portion of plate 56. Bushing 76 has a lateral arm 76A attached to the lower side thereof. A bolt 80 threaded into a hole 80A secures arm 76A to plate 56 and holds bushing 76 in an adjusted position on plate 56. As shown in FIG. 6, plate 56 has a plurality of threaded holes 80A for accommodating bolt 80 to hold arm 76A in an adjusted position. This adjustment permits the lateral or radial adjustment of roller 72 relative to plate 56 and trowel sleeve 64. A threaded end 77 projected downwardly from hub 74 accommodates a nut 78 which fixes axle 73 on bushing 76. Nut 78 can be removed from end 77 to allow roller 72 to be removed from plate 56 for servicing or replacement. Axle 73 has an enlarged head 79 on the upper end thereof. A cylindrical body 81 of metal or like rigid material surrounds axle 73. A pair of bearings 82 and 83 located about axle 73 rotatably mount body 81 thereon. Bearings 82 and 83 are separated with a pair of spacer rings 84 and 86. An annular spacer or washer 87 separates bearing 83 from plate 56 and maintains roller 72 in small clearance relation relative to plate 56. An annular ring or collar 88 surrounds the upper end of bearing 82. A flat cap 89 secured with a plurality of bolts 91 to body 81 covers the top of body 81 and retains lubricants within body 81. Cap 89 has a plurality of upwardly directed generally flat fins or blades 92, 93, 94 and 95 which are operable to work and move concrete toward the inner wall of mold 19. As shown in FIG. 3, fins 92 and 94 are generally parallel to each other on opposite sides of a diameter between fins 92 and 94. Fins 93 and 95 are located generally normal to fins 92 and 94 and on opposite sides of a diameter between fins 93 and 95. The fins 92–95 have a vertical height that is substantially the same as the vertical height as roller 72.

A continuous sleeve 96 of elastic abrasive resistant material, such as solid hard rubber, is located about body 81. Sleeve 96 is press fitted unto the outside cylindrical surface of body 81. Sleeve 96 has an inside cylindrical surface that is smaller than the outer cylindrical surface of the body 81. When sleeve 96 is press fitted unto body 81, it is under continuous tension whereby the sleeve is retained on the body. The sleeve 96 under tension has decreased elastic characteristics. In the event that sleeve 96 is damaged or worn, it can be removed from body 81 and replaced with a new sleeve. Sleeve 96 has a continuous cylindrical outer surface 97 that engages the concrete as roller 72 rolls about its upright axis. Sleeve 96 may be made of hard rubber, such as solid rubber having a hardness of 60 durometer. The hardness of the rubber can vary. Sleeve 96 is made of elastic material that has high resistance to abrasion, high tensile strength, resistance to cracking and skid resistance when wet. The material can be natural rubber or synthetic rubber. An example of a suitable synthetic rubber is polybutadiene. A pin 98 located in aligned holes 99 and 101 in body 81 and sleeve 96 prevent rotational movement or slipping of sleeve 96 on body 81. Other types of elastic materials including plastics can be used for the elastic sleeve 96. Sleeve 96, as shown in FIG. 5, has a uniform thickness of about 2.5 cm and extends the full height of body 81. The thickness of sleeve 96 can vary.

Figure 7:
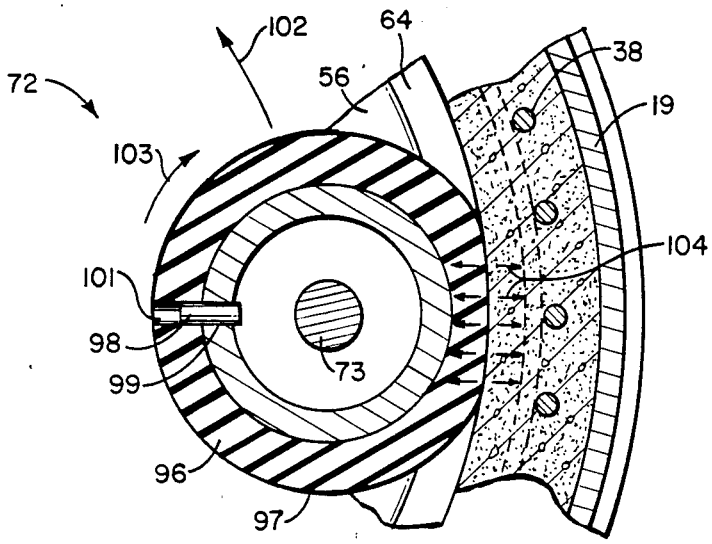
FIG. 7 is an enlarged sectional view taken along the line 7—7 of FIG. 4.

In use, a mold 19 surrounding pallet 17 at the lower end thereof accommodating a wire cage 38 is located below top table 39 in alignment with packerhead 32. Packerhead 32 is moved to the bottom of the mold through hole 18 in turntable 16. Conveyor 43 is then operated to supply concrete to mold 19 chamber above packerhead 32. Packerhead 32 is rotated to move the concrete into the bell end of the pipe and commence the formation of the annular wall of pipe 107. Conveyor 43 is either manually or automatically controlled to maintain a supply of concrete above packerhead 32. Packerhead 32 is rotated at a desired speed as it is raised relative to mold 19. As shown in FIG. 3, on rotation of packerhead 32 in the direction of arrow 102, rollers 69–72 are rotated in the direction of the arrows, such as arrow 103. The working of the concrete against mold 19 by the rollers is emphasized in FIG. 7. Sleeve 96 is slightly compressed as indicated by the arrows 104 and thereby exerts an opposite force on the concrete. The resilient material of sleeve 96 has a gripping action on the concrete so that roller 72 continuously turns. The concrete is worked and pressed around wire cage 38 and against the inside of the wall of mold 19 to form a cylindrical concrete wall. The compressed sleeve 96 has moving surface contact with the concrete being packed in the mold. All of the rollers 69–72 continuously work and pack concrete during the rotation of packerhead 32. The roller 69 and 72 are mounted on the plate 56 so that their radial outer portions thereof extend a short radial distance beyond the cylindrical outer surface 68 of the trowel 64. In other words, the inside diameter of the concrete pipe formed by rollers 69–72 is slightly greater than the inside diameter of the finished pipe as worked by troweling surface 68.

Annular sleeve 64 having the continuous outer surface 68 provides a continuous annular trowel that finishes the inside surface 106 of pipe 107. The packing and troweling action of packerhead 32 is continuous during its rotational and vertical movements from the bottom of the mold to the top ring of the mold. Packerhead 32 forms a smooth inside surface of the concrete pipe as illustrated in FIG. 2. Rollers 69–72 having elastic sleeves do not slide on the concrete and are not easily stopped. The rollers continue to rotate when used of a wide range on concrete mixes. The rollers do not stall in use so that they are not subjected to substantial wear and do not have a short operative life. When the rollers move through the top ring of the mold, they may be deformed thereby decreasing the force that is transmitted to the top ring. This reduces the deformation and breakage of the top ring as the packerhead is moved up above top table 41. Another advantage of the packerhead with rollers equipped with elastic sleeves is a smooth cylindrical outside surface on the finished pipe.

There is shown and described an embodiment of a packerhead having elastic rollers. It is understood that changes in the packerhead and rollers may be made by the persons skilled in the art without departing from the invention. The invention is defined in the following claims.

I claim:

1. A machine for making concrete pipe in an upright mold comprising: a frame, a mold having a mold chamber for accommodating concrete to be formed into a concrete pipe, a packerhead movable in said mold chamber for forming a concrete pipe within said mold, cross head means movably mounted on said frame, means connected to said cross head means to selectively raise and lower the cross head means, means connecting the cross head means to said packerhead whereby said packerhead moves with said cross head means, drive means mounted on the cross head means for rotating said packerhead during upright movement thereof; means for supplying concrete to the mold chamber during the rotation and upright movements of the packerhead whereby the packerhead forms the concrete pipe in the mold, said packerhead comprising a generally circular plate, said means connecting the cross head means to said packerhead including means secured to the center of the plate connected to the drive means, a plurality of rollers rotatably mounted on the plate for rotation about separate generally upright axes for packing concrete in a cylindrical shape within the mold, each of said rollers having an upright roller shaft secured to the plate and projected upwardly therefrom, means mounting the shaft on the plate including an eccentric bushing attached to the shaft, said plate having a hole accommodating said bushing, said bushing being rotatable to adjust the radial position of the roller relative to the plate to vary the packing pressure of the roller on the concrete, and means for holding the bushing in an adjusted position, a generally cylindrical body surrounding said roller shaft, said body having a top end and a generally cylindrical outer surface, bearing means rotatably mounting the body on the roller shaft, a cap mounted directly on the top end of said body closing the upper end thereof, at least one upright fin secured to said cap, a continuous annular sleeve of elastic rubber material surrounding the body and mounted on the cylindrical outer surface thereof, said sleeve having a length about the same as the length of the body and a uniform thickness throughout the length thereof and a continuous cylindrical outer surface, means securing the sleeve to said body to prevent rotation of the sleeve relative to the body, said cylindrical outer surface of the sleeve being engageable with concrete in the mold chamber to insure rotation of the roller and packing of the concrete in the mold, cylindrical side wall secured to the plate and projected downwardly therefrom; and cylindrical trowel means secured to said side wall, said trowel means includes a cylindrical trowel of elastic material having an outer surface for troweling the inside surface of the pipe during movement of the packerhead relative to the mold.

2. The machine of claim 1 wherein: said sleeve has an inside wall located in press fit relationship on said cylindrical outer surface of the body, and said sleeve being in tension to retain the sleeve on the body.

3. The machine of claim 1 wherein: said sleeve has a thickness of at least 2.54 cm.

4. A machine for making concrete product in an upright mold comprising: a frame, a mold having a mold chamber for accommodating concrete to be formed into a generally cylindrical product, a packerhead movable in said mold chamber for forming a concrete product within said mold, means movably mounted on said frame connected to said packerhead to selectively raise and lower the packerhead, drive means for rotating said packerhead during upright movement thereof, means for supplying concrete to the mold chamber during the rotation and upward movement of the packerhead whereby the packerhead forms the concrete product in the mold, said packerhead having a generally circular plate, a plurality of rollers rotatable about separate generally upright axes for packing concrete in a generally cylindrical shape within the mold, each of said rollers having a upright roller shaft secured to the plate and projected upwardly therefrom, adjustable means mounting the shaft on the plate operable to adjust the radial position of the roller relative to the plate to vary the packing pressure of the roller on the concrete, a body surrounding said roller shaft, said body having a generally cylindrical outer surface, means rotatably mounting the body on the roller shaft, an elastic sleeve means surrounding the body and mounted on the outer surface thereof, said elastic sleeve means having a length about the same as the length of the body and a uniform thickness throughout the length thereof and a continuous cylindrical outer surface, means securing the sleeve means to the body to prevent rotation of the sleeve means relative to the body, said cylindrical outer surface of the sleeve means being engageable wth concrete in the mold chamber to insure rotation of the roller and packing of the concrete in the mold, and annular trowel means secured to the plate and projected downwardly therefrom, said trowel means having a surface for troweling the inside surface of the product during movement of the packerhead relative to the mold.

5. The machine of claim 4 wherein: said plate has a hole to accommodate the adjustable means, said adjustable means including an eccentric bushing attached to the shaft, said bushing being rotatable in said hole to adjust the position of the roller relative to the plate to vary the packing pressure of the roller on the concrete, and means for holding the bushing in an adjusted position.

6. The machine of claim 4 wherein: said elastic sleeve means has an inside wall located in pressed fit relationship on said outer surface of the body, said elastic sleeve means being in tension to retain the elastic sleeve means on the body.

7. The machine of claim 4 wherein: said elastic sleeve means is a continuous annular elastic rubber member.

8. The machine of claim 7 wherein: said rubber member has an inside wall located in pressed fit relationship on the outer surface of the body, and said rubber member being under tension to retain the rubber member on the body.

9. The machine of claim 8 wherein: said rubber member has a continuous cylindrical outer surface.

10. The machine of claim 4 including: a cap mounted on the body of each roller, and at least one upright fin secured to each cap.

11. The machine of claim 4 wherein: said outer surface of the body has a cylindrical shape, said elastic sleeve means is an annular sleeve of the elastic rubber material surrounding the body and mounted on the cylindrical outer surface thereof.

12. The machine of claim 4 wherein: said trowel means includes a cylindrical trowel of elastic material having an outer surface for troweling the inside surface of a product during movement of the packerhead relative to a mold.

13. A packerhead for a concrete product making machine comprising: a generally circular plate, a plurality of rollers rotatable about separate generally upright axes for packing concrete in a generally cylindrical shape within a mold, each of said rollers having a upright roller shaft secured to the plate and projected upwardly therefrom, adjustable means mounting the shaft on the plate operable to adjust the radial position of the roller relative to the plate to vary the packing pressure of the roller on the concrete, a body surrounding said roller shaft, said body having a generally cylindrical outer surface, means rotatably mounting the body on the roller shaft, elastic sleeve means surrounding the body and mounted on the cylindrical outer surface thereof, said elastic sleeve means having a length about the same as the length of the body and a uniform thickness throughout the length thereof and a continuous cylindrical outer surface, means securing the sleeve means to the body to prevent rotation of the sleeve means relative to the body, said cylindrical outer surface of the sleeve means being engageable with concrete in the mold chamber to insure rotation of the roller and packing of the concrete in the mold, and annular trowel means secured to the plate and projected downwardly therefrom, said trowel means having a surface for troweling the inside surface of the product during movement of the packerhead relative to the mold.

14. The packerhead of claim 13 wherein: said plate has a hole to accommodate the adjustable means, said adjustable means including an eccentric bushing attached to the shaft, said bushing being rotatable in said hole to adjust the position of the roller relative to the plate to vary the packing pressure of the roller from the concrete, and means for holding the bushing in an adjusted position.

15. The packerhead of claim 13 wherein: said elastic means has an inside wall located in pressed fit relationship on said cylindrical outer surface of the body, said elastic means being in tension to retain the elastic means on the body.

16. The packerhead of claim 15 wherein: said elastic means is a continuous annular elastic rubber member.

17. The packerhead of claim 16 wherein: said rubber member has an inside wall located in pressed fit relationship on the cylindrical outer surface of the body, and said rubber member being under tension to retain the rubber member on the body.

18. The packerhead of claim 13 including: a cap mounted on the body of each roller, and at least one upright fin secured to each cap.

19. The packerhead of claim 13 wherein: said trowel means includes a cylindrical trowel of elastic material having an outer surface for troweling the inside surface of a product during movement of the packerhead relative to a mold.

20. The packerhead of claim 13 wherein: said adjustable means is a cylindrical member having an off-center hole accommodating an end of said shaft, and means attached to the cylindrical member and connected to the plate for holding the cylindrical member in a selected position thereby holding the roller in a selected position on said plate.

21. A packerhead for a concrete product making machine comprising: a generally circular plate, a plurality of rollers rotatable about separate generally upright axes for packing concrete in a generally cylindrical shape within a mold, each of said rollers having an upright roller shaft secured to the plate and projected upwardly therefrom, adjustable means mounting the shaft on the plate operable to adjust the radial position of the roller relative to the plate to vary the packing pressure of the roller on the concrete, a body surrounding said roller shaft, said body having a generally cylindrical outer surface, means rotatably mounting the body on the roller shaft, elastic sleeve means surrounding the body and mounted on the cylindrical outer surface thereof, said elastic sleeve means having a length about the same as the length of the body and uniform thickness throughout the length thereof and a continuous outer surface, means securing the sleeve means to the body to prevent rotation of the sleeve means relative to the body, said cylindrical outer surface of the sleeve means being engageable with concrete in the mold to insure rotation of the roller and the packing of the concrete in the mold.

22. The packerhead of claim 21 wherein: said plate has a hole to accommodate the adjustable means, said adjustable means including an eccentric bushing attachable to the shaft, said bushing being rotatable in said hole to adjust the position of the roller relative to the plate to vary the packing pressure of the roller on the concrete, and means for holding the bushing in an adjusted position.

23. The packerhead of claim 21 including: a cap mounted on the body of each roller, and at least one upright fin secured to each cap.

24. The packerhead of claim 21 wherein: said elastic sleeve means is a continuous annular elastic rubber member having uniform thickness throughout the length thereof.

25. The packerhead of claim 24 wherein: said rubber member has an inside wall located in pressed fit relationship on the cylindrical outer surface of the body, and said rubber member being under tension to retain the rubber member on the body.

26. The packerhead of claim 21 wherein: said adjustable means is a cylindrical member having an off-center hole accommodating an end of said shaft, and means attached to the cylindrical member and connected to the plate for holding the cylindrical member in a selected position thereby holding the roller in a selected radial position on said plate.

* * * * *